US010480338B2

(12) United States Patent
Webb

(10) Patent No.: US 10,480,338 B2
(45) Date of Patent: Nov. 19, 2019

(54) BLADED ROTOR ARRANGEMENT INCLUDING AXIAL PROJECTION

(71) Applicant: ROLLS-ROYCE PLC, London (GB)

(72) Inventor: Michael Webb, Indianapolis, IN (US)

(73) Assignee: ROLLS-ROYCE PLC, London (GB)

( * ) Notice: Subject to any disclaimer, the term of this patent is extended or adjusted under 35 U.S.C. 154(b) by 1106 days.

(21) Appl. No.: 14/848,788

(22) Filed: Sep. 9, 2015

(65) Prior Publication Data

US 2016/0090854 A1 Mar. 31, 2016

(30) Foreign Application Priority Data

Sep. 26, 2014 (GB) ..... 1417038.5

(51) Int. Cl.
*F01D 11/00* (2006.01)
*F01D 5/08* (2006.01)
(Continued)

(52) U.S. Cl.
CPC ..... *F01D 11/006* (2013.01); *F01D 5/02* (2013.01); *F01D 5/081* (2013.01); *F01D 5/141* (2013.01);
(Continued)

(58) Field of Classification Search
CPC ..... F01D 11/006; F01D 5/02; F01D 5/081; F01D 5/141; F01D 5/3007; F01D 5/3015;
(Continued)

(56) References Cited

U.S. PATENT DOCUMENTS 3,853,425 A * 12/1974 Scalzo ..... F01D 5/18 416/193 A
4,019,833 A 4/1977 Gale
(Continued)

FOREIGN PATENT DOCUMENTS

EP 2436879 A2 4/2012
GB 1 286 776 A 8/1972
(Continued)

OTHER PUBLICATIONS

Feb. 24, 2016 Search Report issued in European Patent Application No. 15 18 4468.
(Continued)

*Primary Examiner* — Mark A Laurenzi
*Assistant Examiner* — Paul W Thiede
(74) *Attorney, Agent, or Firm* — Oliff PLC

(57) ABSTRACT

A bladed rotor arrangement comprising a rotor, a plurality of rotor blades, at least one seal plate and a plurality of lock plates. Each rotor blade locates in a corresponding axially extending slot in the rotor. A plurality of lock plates are arranged at a first axial end of the rotor, the radially outer ends of the lock plates engage grooves on the platforms of the rotor blades, and the radially inner ends of the lock plates engage a circumferentially extending groove. The seal plate is arranged at the first axial end of the rotor, the radially inner ends of the lock plates engage the circumferentially extending groove defined by the seal plate. The seal plate has at least one projection extending axially from the seal plate and arranged to locate in a slot in a first axial end of the root of a rotor blade.

16 Claims, 5 Drawing Sheets

(51) Int. Cl.

| | |
|---|---|
| ***F01D 5/30*** | (2006.01) |
| ***F01D 5/32*** | (2006.01) |
| ***F01D 5/02*** | (2006.01) |
| ***F01D 5/14*** | (2006.01) |

(52) U.S. Cl.
CPC ..... *F01D 5/3007* (2013.01); *F01D 5/3015* (2013.01); *F01D 5/326* (2013.01); *F05D 2220/30* (2013.01); *F05D 2240/24* (2013.01); *F05D 2240/30* (2013.01); *F05D 2240/55* (2013.01); *F05D 2260/30* (2013.01)

(58) Field of Classification Search
CPC ..... F01D 5/326; F01D 5/18; F05D 2220/30; F05D 2240/24; F05D 2240/30; F05D 2240/55; F05D 2260/30
USPC ..... 416/97 R, 193 A
See application file for complete search history.

(56) References Cited

U.S. PATENT DOCUMENTS

| | | | | |
|---|---|---|---|---|
| 4,668,167 | A | 5/1987 | Le Maoût et al. | |
| 4,701,105 | A | 10/1987 | Cantor et al. | |
| 4,890,981 | A | 1/1990 | Corsmeier et al. | |
| 5,018,943 | A | 5/1991 | Corsmeier et al. | |
| 6,416,282 | B1 | 7/2002 | Beeck et al. | |
| 10,060,276 | B2 * | 8/2018 | Tanaka | F01D 11/003 |
| 2011/0305560 | A1 | 12/2011 | Belmonte et al. | |

FOREIGN PATENT DOCUMENTS

| | | | | |
|---|---|---|---|---|
| GB | 2409240 | A | 6/2005 | |
| GB | 2 435 909 | A | 9/2007 | |
| WO | WO-2014148566 | A1 * | 9/2014 | F01D 11/003 |

OTHER PUBLICATIONS

Mar. 16, 2015 Search Report issued in British Patent Application No. 1417038.5.

* cited by examiner

BLADED ROTOR ARRANGEMENT INCLUDING AXIAL PROJECTION

FIELD OF THE INVENTION

The present disclosure relates to a bladed rotor arrangement and in particular to a bladed rotor arrangement of a gas turbine engine or a turbomachine.

BACKGROUND TO THE INVENTION

Gas turbine engines comprise a plurality of bladed rotors, each of which comprises a rotor and a plurality of rotor blades mounted on the periphery of the rotor. Each rotor blade has an aerofoil, a platform, a shank and a root. The rotor comprises a plurality of circumferentially spaced axially extending slots. The root of each rotor blade is arranged to locate in a respective one of the axially extending slots in the periphery of the rotor. The roots of the rotor blades are generally fir tree shaped or dovetail shaped and the axially extending slots are correspondingly shaped to receive the roots of the rotor blades.

The bladed rotor arrangement also comprises a plurality of lock plates arranged at a first axial end of the rotor and a plurality of lock plates arranged at a second axial end of the rotor to prevent the rotor blades moving axially relative to the rotor. The lock plates also act as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades and the radially outer ends of the lock plates at the second axial end of the rotor engage grooves defined by radially inwardly extending flanges on the platforms of the rotor blades. The radially inner ends of the lock plates at the first axial end of the rotor engage a circumferentially extending groove defined by the rotor and a seal plate arranged at the first axial end of the rotor and the radially inner ends of the lock plates at the second axial end of the rotor engage a circumferentially extending groove defined by the rotor and a seal plate arranged at the second axial end of the rotor. The seal plates are designed to remain rotationally stationary relative to the bladed rotor.

However, the arrangement described has suffered from a problem in that the seal plates may be able to rotate relative to the rotor when the gas turbine engine is operating, this may result in the seal plates becoming dislodged and in the case of a turbine rotor this may lead to leakage of coolant supplied to the turbine rotor and/or turbine blades and failure of the turbine blades.

Therefore the present disclosure seeks to provide a novel bladed rotor arrangement which reduces or overcomes the above mentioned problem.

STATEMENTS OF INVENTION

Accordingly the present disclosure provides a bladed rotor arrangement comprising a rotor, a plurality of rotor blades, at least one seal plate and a plurality of lock plates, the rotor blades being mounted on the periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, a plurality of lock plates being arranged at a first axial end of the rotor, the radially outer ends of the lock plates at the first axial end of the rotor engaging grooves defined by radially inwardly extending flanges on the platforms of the rotor blades, at least one seal plate being arranged at the first axial end of the rotor, the radially inner ends of the lock plates at the first axial end of the rotor engaging a circumferentially extending groove at least partially defined by the at least one seal plate at the first axial end of the rotor, the at least one seal plate at the first axial end of the rotor having at least one anti-rotation feature, the at least one anti-rotation feature comprising a projection extending axially from the at least one seal plate and arranged to locate in a slot in a first axial end of the root of a rotor blade.

A plurality of lock plates may be arranged at a second axial end of the rotor, the radially outer ends of the lock plates at the second axial end of the rotor engaging grooves defined by radially inwardly extending flanges on the platforms of the rotor blades, at least one seal plate being arranged at the second axial end of the rotor, the radially inner ends of the lock plates at the second axial end of the rotor engaging a circumferentially extending groove at least partially defined by the at least one seal plate at the second axial end of the rotor, the at least one seal plate at the second axial end of the rotor having at least one anti-rotation feature, the at least one anti-rotation feature comprising a projection extending axially from the at least one seal plate and arranged to locate in a slot in a second axial end of the root of a rotor blade.

A single seal plate may be arranged at the first axial end of the rotor, the single seal plate having a plurality of anti-rotation features, each anti-rotation feature comprising a projection extending axially from the single seal plate and each anti-rotation feature being arranged to locate in a slot in the first axial end of the root of a corresponding rotor blade.

A single seal plate may be arranged at the second axial end of the rotor, the single seal plate having a plurality of anti-rotation features, each anti-rotation feature comprising a projection extending axially from the single seal plate and each anti-rotation feature being arranged to locate in a slot in the second axial end of the root of a corresponding rotor blade.

The single seal plate at the first axial end of the rotor may have an axially extending flange defining the circumferentially extending groove and/or the single seal plate at the second axial end of the rotor may have an axially extending flange defining the circumferentially extending groove.

The anti-rotation feature or anti-rotation features may extend from the axially extending flange on the single seal plate at the first axial end of the rotor and/or the anti-rotation feature or anti-rotation features may extend from the axially extending flange on the single seal plate at the second axial end of the rotor.

A plurality of seal plates may be arranged at the first axial end of the rotor and a plurality of seal plates may be arranged at the second axial end of the rotor, the radially inner ends of the lock plates at the first axial end of the rotor engaging circumferentially extending grooves at least partially defined by the seal plates at the first axial end of the rotor, the radially inner ends of the lock plates at the second axial end of the rotor engaging circumferentially extending grooves at least partially defined by the seal plates at the second axial end of the rotor.

Each seal plate at the first axial end of the rotor may have an anti-rotation feature, each anti-rotation feature comprising a projection extending axially from the seal plate, the anti-rotation feature of each seal plate being arranged to locate in a slot in the first axial end of the root of a corresponding rotor blade and/or each seal plate at the second axial end of the rotor may have an anti-rotation feature, each anti-rotation feature comprising a projection extending axially from the seal plate, the anti-rotation feature of each seal plate being arranged to locate in a slot in the second axial end of the root of a corresponding rotor blade.

Each of the seal plates at the first axial end of the rotor may have an axially extending flange to define the circumferentially extending groove and/or each of the seal plates at the second axial end of the rotor may have an axially extending flange to define the circumferentially extending groove.

Each of the seal plates at the first axial end of the rotor may have an anti-rotation feature extending axially from the flange and/or each of the seal plates at the second axial end of the rotor may have an anti-rotation feature extending axially from the flange.

The roots of the rotor blades may be generally fir tree shaped or dovetail shaped and the axially extending slots are correspondingly shaped to receive the roots of the rotor blades.

The radially outer end of each lock plate may have a lip and the radially inner end of each lock plate may have a lip.

Each lock plate may have a first face facing away from the rotor and a second face facing the rotor.

The first face of each lock plate may be generally flat between the lips at the radially inner and radially outer ends of the lock plate.

The second face of each lock plate may have at least one channel and at least one deflector, the at least one channel extending radially from the radially inner end of the lock plate towards the radially outer end of the lock plate, the at least one deflector being arranged at the radially outer end of the at least one channel, the at least one deflector extending axially from the second surface of the lock plate.

The second face of each lock plate may have a plurality of channels and a plurality of deflectors, each channel extending radially from the radially inner end of the lock plate towards the radially outer end of the lock plate, each deflector being arranged at the radially outer end of a corresponding one of the channels, each deflector extending axially from the second surface of the lock plate.

The second face of each lock plate may have at least one pocket. The second face of each lock plate may have a plurality of pockets.

The second face of each lock plate may have anti-rotation feature. The anti-rotation feature may be a projection extending axially from the second face of the lock plate and arranged to locate in a slot in the root of a rotor blade. The anti-rotation feature may be a pair of circumferentially spaced projections extending axially from the second face of the lock plate, the projections being arranged to locate against the shanks of circumferentially spaced apart rotor blades.

The bladed rotor arrangement may comprise a turbine disc and a plurality of turbine rotor blades.

BRIEF DESCRIPTION OF THE DRAWINGS

The present disclosure will be more fully described by way of example with reference to the accompanying drawings, in which.

DETAILED DESCRIPTION

Figure 1:
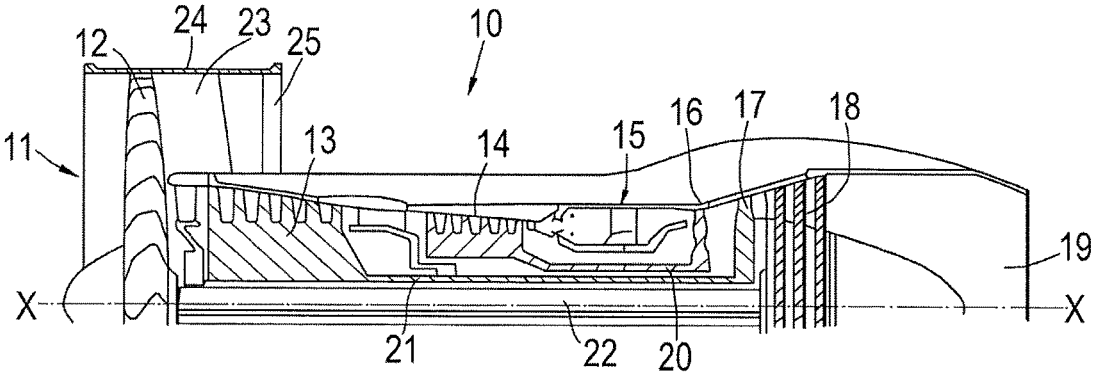
FIG. 1 is sectional side view of an upper half of a turbofan gas turbine engine having a bladed rotor arrangement according to the present disclosure.
Figure 2:
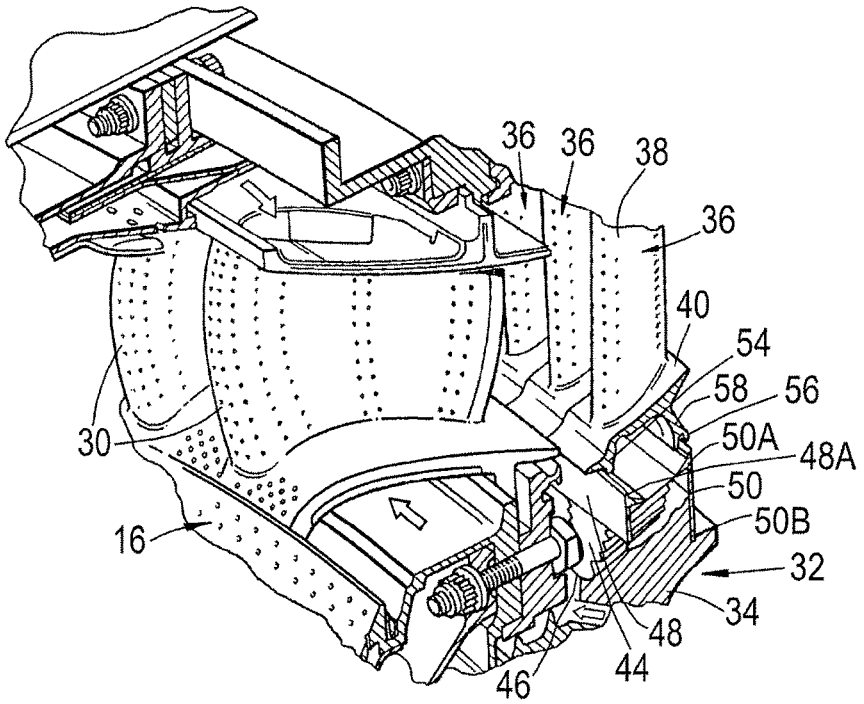
FIG. 2 is a perspective view of part of a turbine of the turbofan gas turbine engine showing the bladed rotor arrangement according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 20. The intermediate pressure turbine 17 is arranged to drive the intermediate pressure compressor 13 via a second shaft 21 and the low pressure turbine 18 is arranged to drive the fan 12 via a third shaft 22. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine and flows through a bypass duct 23 defined by a fan casing 24. The second portion of air leaving the bypass duct 23 flows through a bypass, or fan, nozzle 25 to provide propulsive thrust.

A part of the high pressure turbine 16 of the turbofan gas turbine engine 10 is shown more clearly in FIGS. 2 to 9. The high pressure turbine 16 comprises a plurality of nozzle guide vanes 30 which guide hot gases from the combustion chamber 15 onto the turbine rotor blades 36 of a bladed turbine rotor arrangement 32. The bladed turbine rotor arrangement 32 comprises a turbine rotor 34, a plurality of turbine rotor blades 36 and a plurality of lock plates 48 and 50. The turbine rotor blades 36 are mounted on the periphery of the turbine rotor 34 and each turbine rotor blade 36 comprises an aerofoil 38, a platform 40, a shank 42 and a root 44. The turbine rotor 34 comprises a plurality of circumferentially spaced axially extending slots 46 and the root 44 of each turbine rotor blade 36 locates in a respective one of the axially extending slots 46 in the periphery of the turbine rotor 34. The turbine rotor 34 in this example comprises a turbine disc. The roots 44 of the turbine rotor blades 36 are generally fir tree shaped and the axially extending slots 46 are correspondingly shaped to receive the roots 44 of the turbine rotor blades 36. However, the roots 44 of the turbine rotor blades 36 may be dovetail shaped and the axially extending slots 46 are correspondingly shaped to receive the roots 44 of the turbine rotor blades 36.

A plurality of lock plates 48 are arranged at a first axial end, the upstream end, of the turbine rotor 34 and a plurality of lock plates 50 are arranged at a second axial end, the downstream end, of the turbine rotor 34. The lock plates 48 and 50 prevent the turbine rotor blades 36 moving axially upstream and downstream respectively relative to the turbine rotor 34. The lock plates 48 and 50 also acts as seals to prevent fluid flowing through the axially extending slots 46 in the turbine rotor 34 and axially between the shanks 42 of the turbine rotor blades 36 and radially between the platforms 40 of the turbine rotor blades 36 and the periphery of the turbine rotor 34. The radially outer ends 48A of the lock plates 48 at the first axial end of the turbine rotor 34 engage grooves 52 defined by radially inwardly extending flanges 54 on the first axial ends, upstream ends, of the platforms 40 of the turbine rotor blades 36 and the radially outer ends 50A of the lock plates 50 at the second axial end of the turbine rotor 34 engage grooves 56 defined by radially inwardly extending flanges 58 on the second axial ends, downstream ends, of the platforms 40 of the turbine rotor blades 36. The radially inner ends 48B and 50B of the lock plates 48 and 50 engage circumferentially extending grooves 60 and 62 respectively.

Figure 3:
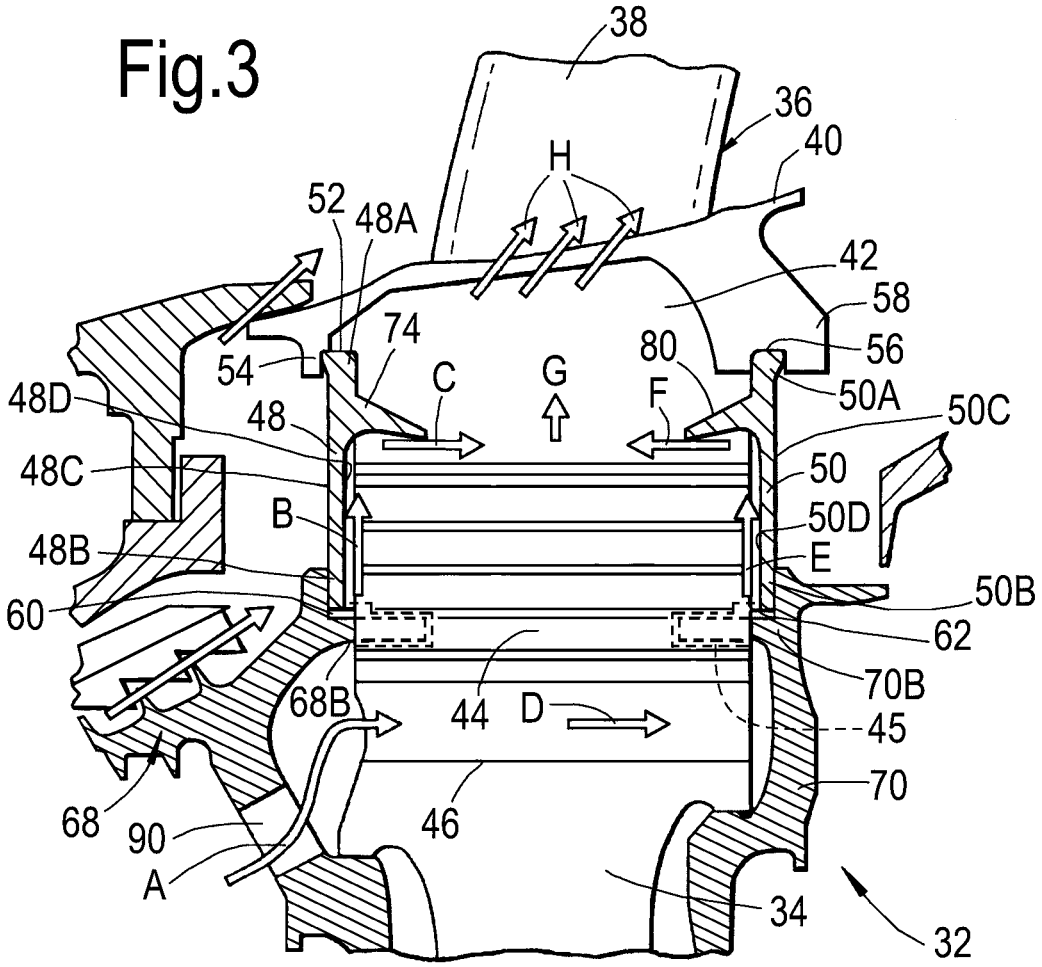
FIG. 3 is an enlarged cross-sectional view of the bladed rotor arrangement according to the present disclosure.
Figure 4:
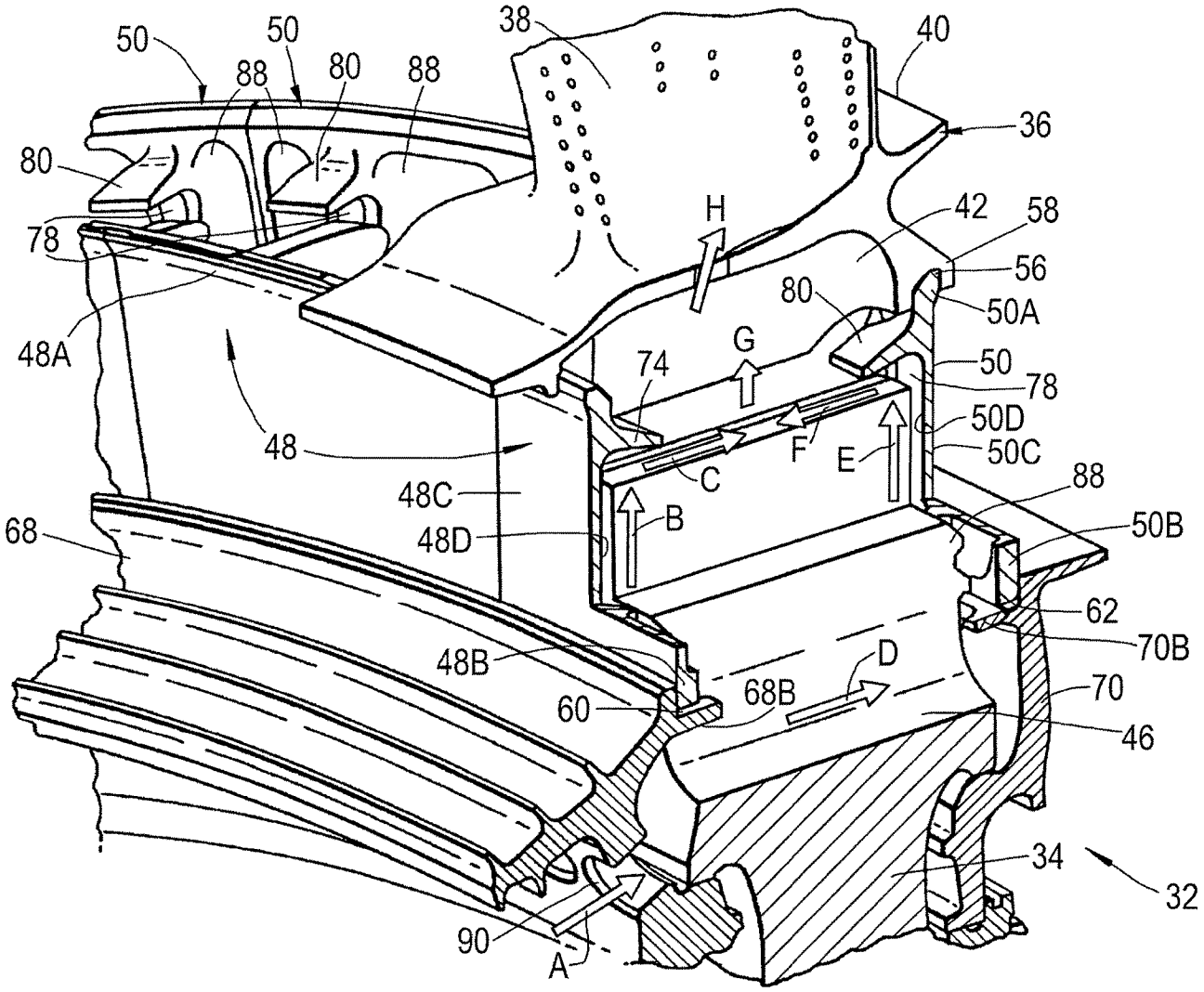
FIG. 4 is a perspective sectional side view of the bladed rotor arrangement according to the present disclosure.

The bladed turbine rotor arrangement 32 also comprises a plurality of seal plates, as seen in FIGS. 3 and 4. A single seal plate 68 or a plurality of seal plates 68 are arranged at the first axial end of the turbine rotor 34 and a single seal plate 70 or a plurality of seal plates 70 are arranged at the second axial end of the turbine rotor 34. If a single seal plate 68 is used then this is a ring and if a single seal plate 70 is used then this is a ring. The radially inner ends 48B of the lock plates 48 at the first axial end of the turbine rotor 34 engage, locate in, the circumferentially extending groove 60 at least partially defined by the seal plate, or seal plates, 68 at the first axial end of the turbine rotor 34 and the first axial end of the turbine rotor 34. The radially inner ends 50B of the lock plates 50 at the second axial end of the turbine rotor 34 engage, locate in, the circumferentially extending groove 62 at least partially defined by the seal plate, or seal plates, 70 at the second axial end of the turbine rotor 34 and the second axial end of the turbine rotor 34. The seal plate 68 is arranged to press the lock plates 48 towards the first axial end of the turbine rotor 34 and similarly the seal plate 70 is arranged to press the lock plates 50 towards the second axial end of the turbine rotor 34.

The seal plate, or seal plates, 68 have an outer radius which is less than the outer radius of the periphery of the turbine rotor 34, the seal plate, or seal plates, 68 have an outer radius which is greater than the radius of the radially inner ends of the slots 46 in the periphery of the turbine rotor 34 and the seal plate, or seal plates, 68 have an outer radius which is greater than the radius of the radially inner ends of the roots 44 of the turbine rotor blades 36. Similarly the seal plate, or seal plates, 70 have an outer radius which is less than the outer radius of the periphery of the turbine rotor 34, the seal plate, or seal plates, 70 have an outer radius which is greater than the radius of the radially inner ends of the slots 46 in the periphery of the turbine rotor 34 and the seal plate, or seal plates, 70 have an outer radius which is greater than the radius of the radially inner ends of the roots 44 of the turbine rotor blades 36.

The seal plate 68 and the lock plates 48 are configured and dimensioned so that under adverse tolerances the inner radii of the lock plates 48 are always at a lower radius than the outer radius of the seal plate 68 and provide sufficient radial overlap. The seal plate 70 and the lock plates 50 are configured and dimensioned so that under adverse tolerances the inner radii of the lock plates 50 are always at a lower radius than the outer radius of the seal plate 70 and provide sufficient radial overlap.

Figure 6:
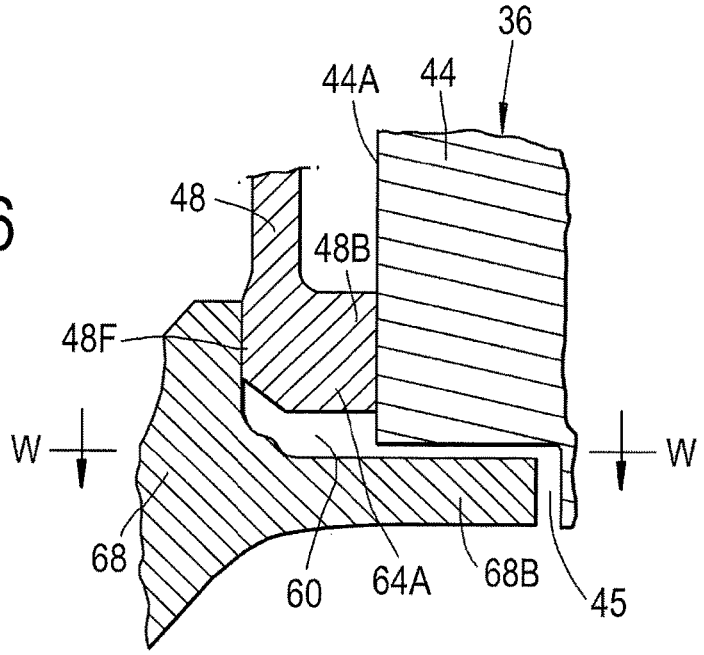
FIG. 6 is a further enlarged cross-sectional view of the radially inner end of a lock plate, the radially outer end of a seal plate and the base of a rotor blade shown in FIGS. 3 and 4.
Figure 7:
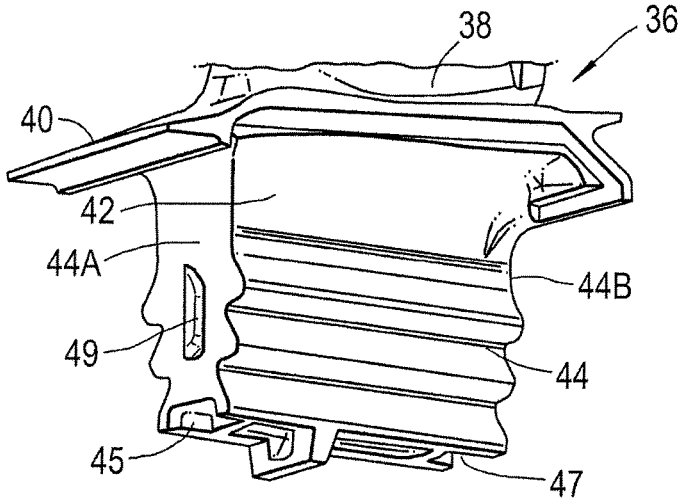
FIG. 7 is a perspective view of a rotor blade of the bladed rotor arrangement according to the present disclosure.
Figure 8:
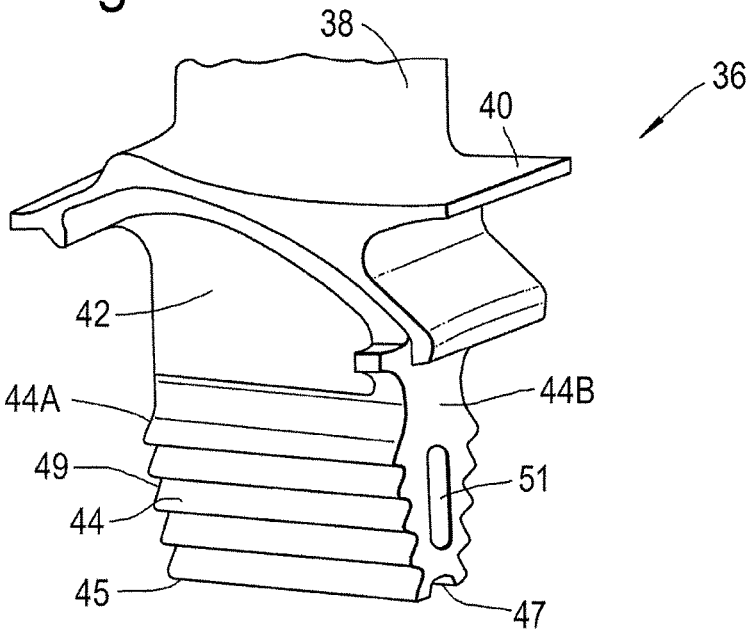
FIG. 8 is a further perspective view of a rotor blade of the bladed rotor arrangement according to the present disclosure.

The seal plate, or seal plates, 68 have anti-rotation features 68B which extend in an axially downstream direction therefrom, a single anti-rotation feature 68B is seen more clearly in FIG. 6. Each anti-rotation feature 68B comprises a projection, which locates in a slot 45 at the first axial end, the upstream end, 44A of the radially inner end of the root 44 of a corresponding one of the turbine rotor blades 36, as seen in FIG. 7. Similarly the seal plate, or seal plates, 70 have anti-rotation features 70B which extend in an axially upstream direction therefrom. Each anti-rotation feature 70B comprises a projection, which locates in a slot 47 at the second end, the downstream end, 44B of the radially inner end of the root 44 of a corresponding one of the turbine rotor blades 36, as seen in FIG. 8. The slots 45 and 47 are actually formed in the bottom surface of the root 44 in this example.

Figure 9:
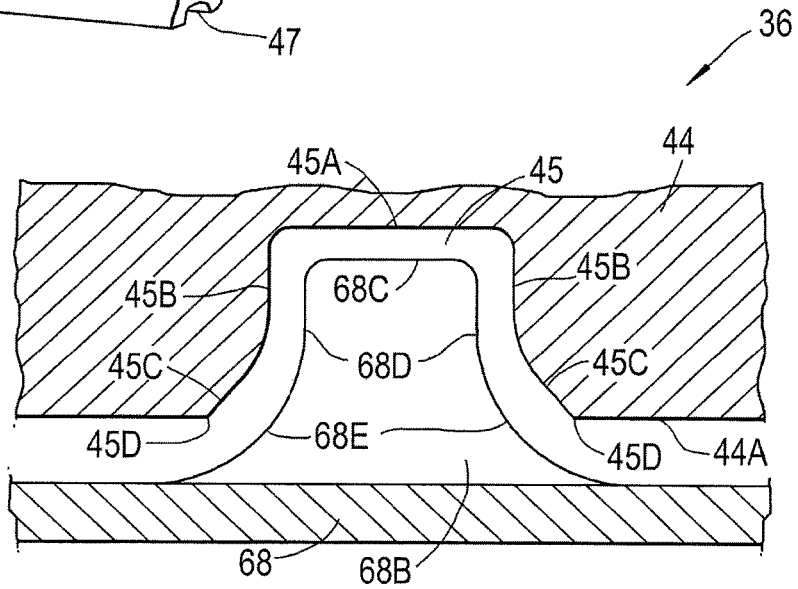
FIG. 9 is an enlarged cross-sectional view in the direction of Arrows W-W in FIG. 6.

One of the anti-rotation features 68B and the slot 45 in the upstream end 44A of the root 44 of the corresponding turbine rotor blade 36, is shown more clearly in FIG. 9. The slots 45 in the roots 44 of the turbine rotor blades 36 and the anti-rotation features 68B on the seal plate 68 are shaped to minimise any stresses which may be imparted into the seal plate 68 when the seal plate 68 contacts a turbine rotor blade 36. Similarly the slot 47 in the roots 44 of the turbine rotor blades 36 and the anti-rotation features 70B on the seal plate 70 are shaped to minimise any stresses which may be imparted into the seal plate 70 when the seal plate 70 contacts a turbine rotor blade 36. The shape of an anti-rotation features 68B on the seal plate 68 and the shape of a slot 45 in a root 44 of a turbine rotor blade 36 are shown in FIG. 9. The slot 45 has a flat, planar, base 45A and the anti-rotation feature 68B has a matching flat, planar, remote end 68C. The slot 45 has flat, planar, circumferentially spaced side surfaces 45B adjacent to the base 45A and the side surfaces 45B are parallel and the anti-rotation feature 68B has matching flat, planar, parallel side surfaces 68D adjacent to the remote end 68C of the anti-rotation feature 68B. The slot 45 has flat, planar, circumferentially spaced chamfered side surfaces 45C which intersect 45D with the adjacent surface 44A of the root 44 and which blend smoothly into the side surfaces 45B. The anti-rotation feature 68B has radiused side surfaces 68E which blend smoothly from the parallel side surfaces 68D to the seal plate 68. The angles of the chamfered sides surfaces 45C and the radius of the radiused side surfaces 68E are arranged to ensure that the radiused side surfaces 68E are not contacted by the intersections 45D between the chamfered side surfaces 45C and the surface 44A of the root 44. The anti-rotation feature 68B has a sufficient axial dimension to ensure that one of the side surfaces 68D gives flat to flat contact with the corresponding side surface 45B of the slot 45 to prevent rotation of the seal plate 68. Under adverse tolerances if the anti-rotation feature 68B is axially longer than required and the slot 45 is axially not as deep as, shallower than, required the side surface 45B of the slot 45 may also contact the radiused side surface 68E of the anti-rotation feature 68.

In this example a single seal plate 68 is provided at the first axial end of the turbine rotor 34, the single seal plate 68 has an axially extending flange to define the circumferentially extending groove 60 and in this example a single seal plate 70 is provided at the second axial end of the turbine rotor 34, the single seal plate 70 is provided with an axially extending flange to define the circumferentially extending groove 62. The single seal plate 68 provided at the first axial end of the turbine rotor 34 has a plurality of anti-rotation features 68B and each anti-rotation feature comprises a projection extending axially from the single seal plate 68 and each anti-rotation feature 68 is arranged to locate in a slot 45 in the first axial end of the root 44 of a corresponding turbine rotor blade 36. The single seal plate 70 provided at the second axial end of the turbine rotor 34 has a plurality of anti-rotation features 70B and each anti-rotation feature 70B comprises a projection extending axially from the single seal plate 70 and each anti-rotation feature 70B is arranged to locate in a slot 47 in the second axial end of the root 44 of a corresponding turbine rotor blade 36. The anti-rotation features 68 extend from the axially extending flange on the single seal plate 68 at the first axial end of the turbine rotor 34 and the anti-rotation features 70B extend from the axially extending flange on the single seal plate 70 at the second axial end of the turbine rotor 34. The seal plate 68 also carries a plurality of axially spaced circumferentially extending lands which define a labyrinth seal with an adjacent static structure to control a flow of coolant over the first face 48C of the lock plates 48.

It may be possible to provide a plurality of seal plates 68 at the first axial end of the turbine rotor 34, each of the seal plates 68 has an axially extending flange to define the circumferentially extending groove 60 and/or it may be possible to provide a plurality of seal plates 70 at the second axial end of the turbine rotor 34, each of the seal plates 70 has an axially extending flange to define the circumferentially extending groove 62. If a plurality of seal plates 68 are provided at the first axial end of the turbine rotor 34, each seal plate 68 has an anti-rotation feature 68B and each anti-rotation feature 68B comprises a projection extending axially from the seal plate 68 and the anti-rotation feature 68B of each seal plate 68 is arranged to locate in a slot 45 in the first axial end of the root 44 of a corresponding turbine rotor blade 36. If a plurality of seal plates 70 are provided at the second end of the turbine rotor 34, each seal plate 70 has an anti-rotation feature 70B and each anti-rotation feature 70B comprises a projection extending axially from the seal plate 70 and the anti-rotation feature 70B of each seal plate 70 is arranged to locate in a slot 47 in the second axial end of the root 44 of a corresponding turbine rotor blade 36. Each of the seal plates 68 at the first axial end of the turbine rotor 34 has an anti-rotation feature 68B extending axially from its axially extending flange and each of the seal plates 70 at the second axial end of the turbine rotor 34 has an anti-rotation feature 70B extending axially from its axially extending flange.

Figure 5:
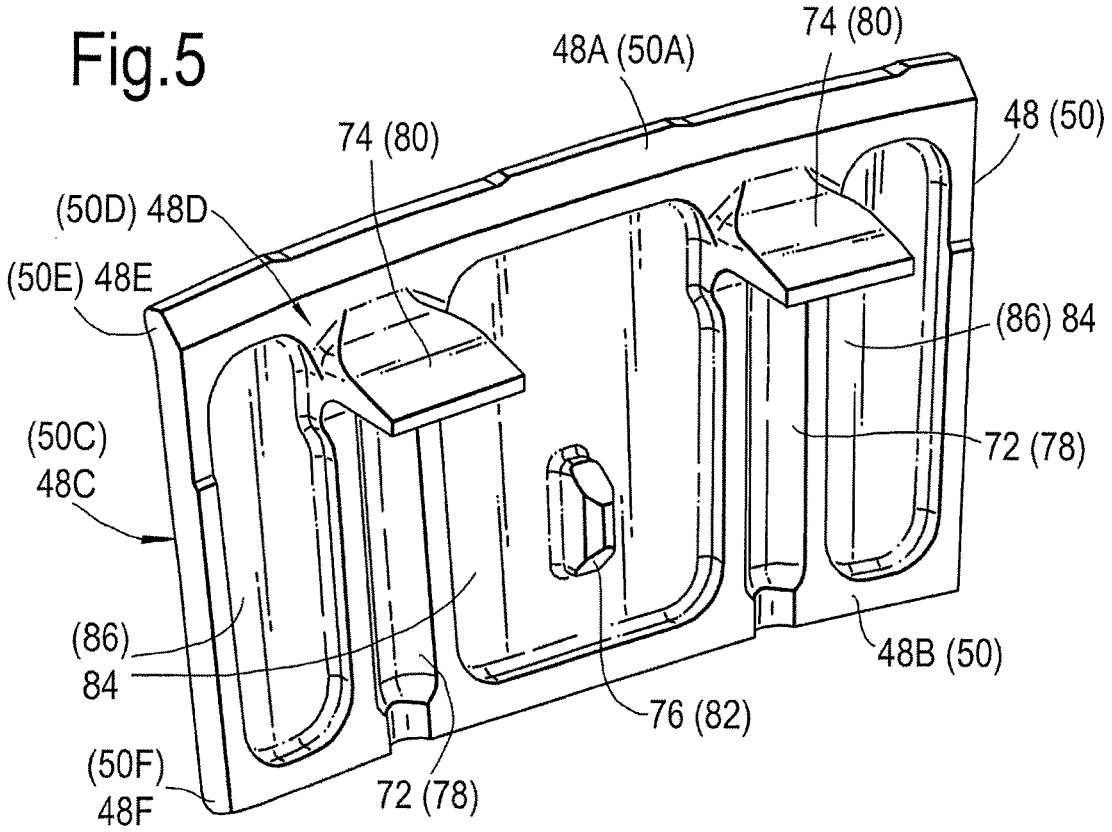
FIG. 5 is an enlarged perspective view of a lock plate of the bladed rotor arrangement according to the present disclosure.

The radially outer end 48A of each lock plate 48 has a lip 48E and the radially inner end 48B of each lock plate 48 has a lip 48F, as seen in FIG. 5. Each lock plate 48 has a first face 48C facing away from the turbine rotor 34 and a second face 48D facing the turbine rotor 34. The first face 48C of each lock plate 48 is generally flat between the lips at the radially inner and radially outer ends 48A and 48B of the lock plate 48. The second face 48B of each lock plate 48 has at least one channel 72 and at least one deflector 74. The at least one channel 72 extends radially from the radially inner end 48B of the lock plate 48 towards the radially outer end 48A of the lock plate 48. The at least one deflector 74 is arranged at the radially outer end of the at least one channel 72 and the at least one deflector 74 extending axially from the second face 48D of the lock plate 48. Preferably the second face 48D of each lock plate 48 has a plurality of channels 72 and a plurality of deflectors 74. Each channel 72 extends radially from the radially inner end 48B of the lock plate 48 towards the radially outer end 48A of the lock plate 48, each deflector 74 is arranged at the radially outer end of a corresponding one of the channels 72 and each deflector extends axially from the second face 48D of the lock plate 48.

Similarly, the radially outer end 50A of each lock plate 50 has a lip 50E and the radially inner end 50B of each lock plate 50 has a lip 50F, as seen in FIG. 5. Each lock plate 50 has a first face 50C facing away from the turbine rotor 34 and a second face 50D facing the turbine rotor 34. The first face 50C of each lock plate 50 is generally flat between the lips at the radially inner and radially outer ends 50A and 50B of the lock plate 50. The second face 50D of each lock plate 50 has at least one channel 78 and at least one deflector 80. The at least one channel 78 extends radially from the radially inner end 50B of the lock plate 50B towards the radially outer end 50A of the lock plate 50. The at least one deflector 80 is arranged at the radially outer end of the at least one channel 78 and the at least one deflector 80 extends axially from the second face 50D of the lock plate 50. Preferably the second face 50D of each lock plate 50 has a plurality of channels 78 and a plurality of deflectors 80. Each channel 78 extends radially from the radially inner end of the lock plate 50B towards the radially outer end 50A of the lock plate 50, each deflector 80 is arranged at the radially outer end of a corresponding one of the channels 78 and each deflector 80 extends axially from the second face 50D of the lock plate 50.

In operation coolant, air, A is supplied through apertures 90 in the seal plate, or seal plates, 68 and the coolant flows radially outwardly over the upstream surface of the turbine rotor 34. The channels 72 and 78 on the lock plates 48 and 50 respectively enable flows of coolant, air, B and E respectively radially outwardly over the surfaces at the upstream and downstream ends of the turbine rotor 34 between the axially extending slots 46, e.g. over the surfaces of the turbine rotor posts 88. The coolant flow E initially flows D axially along the slots 46 and underneath the roots 44 of the turbine rotor blades 36. The coolant, air, is deflected by the deflectors 74 and 80 on the lock plates 48 and 50 respectively so that the coolant, air, flows C and F respectively axially over the radially outer peripheral surface of the turbine rotor 34 axially between the axially extending slots 46. The portions of the turbine rotor 34 between the axially extending slots 46 are called turbine rotor posts 88. The coolant, air, then flows G into the spaces defined the between the platforms 40 and shanks 42 of adjacent turbine rotor blades 36, the turbine rotor posts 88 and the lock plates 48 and 50. The coolant, air, then flows H out of these spaces through apertures in the platforms 40 of the turbine rotor blades 36. Some of the coolant flow D through the slots 46 flows into the turbine rotor blades 36 to cool the rotor blades 36.

The seal plates 68 and 70 and the lock plates 48 and 50 control the coolant flow over the upstream and downstream surfaces of the turbine rotor 34, the surfaces of the turbine rotor posts 88 and the coolant flow into the turbine rotor blades 36.

The second face 48D of each lock plate 48 has at least one pocket 84 and preferably the second face 48D of each lock plate 48 has a plurality of pockets 84. Similarly, the second face 50D of each lock plate 50 has at least one pocket 86 and preferably the second face 50D of each lock plate 50 has a plurality of pockets 86.

The second face 48D of each lock plate 48 has an anti-rotation feature 76. The anti-rotation feature 76 is a projection extending axially from the second face 48D of the lock plate 48 and is arranged to locate in a slot 49 at the first axial end, the upstream end, 44A of the root 44 of a turbine rotor blade 36. Alternatively, the anti-rotation feature may comprise a pair of circumferentially spaced projections extending axially from the second face of the lock plate, the projections being arranged to locate against the shanks of circumferentially spaced apart turbine rotor blades.

Similarly, the second face 50D of each lock plate 50 has an anti-rotation feature 82. The anti-rotation feature 82 is a projection extending axially from the second face 50D of the lock plate 50 and is arranged to locate in a slot 51 at the second axial end, the downstream end, 44B of the root 44 of a turbine rotor blade 36. Alternatively, the anti-rotation feature may comprise a pair of circumferentially spaced projections extending axially from the second face of the lock plate, the projections being arranged to locate against the shanks of circumferentially spaced apart turbine rotor blades.

The advantage of the present disclosure is that the anti-rotation features, projections, on the seal plate prevent rotation of the seal plate relative to the rotor.

Although the present disclosure has been described with reference to a bladed turbine rotor arrangement of a high pressure turbine it is equally applicable to a bladed turbine rotor arrangement of an intermediate pressure turbine or a low pressure turbine.

Although the present disclosure has been described with reference to a bladed turbine rotor arrangement it is equally applicable to a bladed compressor rotor arrangement, whether a high pressure compressor, an intermediate pressure compressor or a low pressure compressor or a fan. A bladed compressor rotor may comprise a compressor disc or a compressor drum. The bladed compressor rotor arrangement may comprise a compressor disc and a plurality of compressor rotor blades or a compressor drum and a plurality of compressor rotor blades.

Although the present disclosure has been described with reference to bladed rotor arrangement for a gas turbine engine, it is equally applicable to a bladed rotor arrangement for other types of turbomachine, e.g. a steam turbine etc.

The invention claimed is:

1. A bladed rotor arrangement comprising:

a rotor including a plurality of circumferentially-spaced, axially-extending slots in a periphery of the rotor, the rotor having a first axial end and a second axial end;

a plurality of rotor blades mounted on the periphery of the rotor, each rotor blade of the plurality of rotor blades including:

an aerofoil, a platform having at least one radially inwardly extending flange, a shank, and a root disposed in a corresponding axially-extending slot of the plurality of axially-extending slots of the rotor;

a first seal plate and a second seal plate, the first seal plate being disposed at the first axial end of the rotor and having a projection inserted axially into a secondary slot disposed in a first axial end of the root of a rotor blade of the plurality of rotor blades, the root of the rotor blade of the plurality of rotor blades surrounding each circumferential-facing surface of the inserted projection; and a plurality of first lock plates disposed at the first axial end of the rotor, each lock plate of the plurality of first lock plates having a radially inner end and a radially outer end, the radially outer end of each first lock plate of the plurality of first lock plates engaging at least one first groove formed by at least one flange of the platforms of the plurality of rotor blades, the radially inner end of each first lock plate of the plurality of first lock plates engaging a circumferentially extending second groove formed by the first seal plate.

2. The bladed rotor arrangement as claimed in claim 1, further comprising:

a plurality of second lock plates arranged at a second axial end of the rotor, the radially outer ends of each second lock plate of the plurality of second lock plates at the second axial end of the rotor engaging at least one third groove defined by at least one secondary radially inwardly extending flange on the platforms of the rotor blades, the second seal plate being arranged at the second axial end of the rotor, the radially inner ends of each second lock plate of the plurality of second lock plates at the second axial end of the rotor engaging a circumferentially extending groove at least partially defined by the second seal plate, the second seal plate having a second projection inserted axially into a tertiary slot disposed in a second axial end of the root of the rotor blade of the plurality of rotor blades.

3. The bladed rotor arrangement as claimed in claim 2, wherein the first seal plate includes a plurality of projections axially inserted from the first seal plate into a plurality of secondary slots disposed in the first axial end of the root of the rotor blade of the plurality of rotor blades, and the second seal plate includes a plurality of secondary projections axially inserted from the first seal plate into a plurality of tertiary slots in the second axial end of the root of the rotor blade of the plurality of rotor blades.

4. The bladed rotor assembly as claimed in claim 3, wherein:

the first seal plate includes an axially extending flange defining the circumferentially extending second groove, and the second seal plate includes an axially extending flange defining the circumferentially extending second groove.

5. The bladed rotor assembly as claimed in claim 4, wherein:

the projections extend from the axially extending flange on the first seal plate, and the projections extend from the axially extending flange on the second seal plate.

6. The bladed rotor arrangement as claimed in claim 5, wherein the second face of each lock plate of the plurality of lock plates includes at least one pocket.

7. The bladed rotor arrangement as claimed in claim 6, wherein the second face of each first lock plate of the plurality of first lock plates includes a plurality of pockets.

8. The bladed rotor arrangement as claimed in claim 5, wherein the second face of each first lock plate of the plurality of first lock plates has a projection axially inserted in a secondary slot in the root of a rotor blade.

9. The bladed rotor arrangement as claimed in claim 1, wherein the first seal plate includes a plurality of projections axially inserted from the first seal plate into a plurality of secondary slots disposed in the first axial end of the root of the rotor blade of the plurality of rotor blades.

10. The bladed rotor arrangement as claimed in claim 9, wherein the first seal plate at the first axial end of the rotor includes an axially extending flange defining the circumferentially extending groove.

11. The bladed rotor arrangement as claimed in claim 10, wherein the plurality of projections extend from the axially extending flange on the first seal plate at the first axial end of the rotor.

12. The bladed rotor arrangement as claimed in claim 1, wherein:

the roots of the plurality of rotor blades are selected from the group consisting of fir tree shaped roots and dovetail shaped roots, and the axially extending slots are correspondingly shaped to receive the roots of the plurality of rotor blades.

13. The bladed rotor arrangement as claimed in claim 1, wherein each first lock plate of the plurality of first lock plates includes a first face facing away from the rotor and a second face facing the rotor.

14. The bladed rotor arrangement as claimed in claim 13, wherein the second face of each first lock plate of the plurality of first lock plates includes at least one channel and at least one deflector, the at least one channel extending radially from the radially inner end of each first lock plate of the plurality of first lock plates towards the radially outer end of each first lock plate of the plurality of first lock plates, the at least one deflector being arranged at the radially outer end of the at least one channel, the at least one deflector extending axially from the second surface of each lock plate of the plurality of first lock plates.

15. The bladed rotor arrangement as claimed in claim 14, wherein the second face of each first lock plate of the plurality of first lock plates includes a plurality of channels and a plurality of deflectors, each channel of the plurality of channels extending radially from the radially inner end of each first lock plate of the plurality of first lock plates towards the radially outer end of each first lock plate of the plurality of first lock plates, each deflector of the plurality of deflectors being arranged at the radially outer end of a corresponding channel of the plurality of channels, each deflector of the plurality of deflectors extending axially from the second surface of each first lock plate of the plurality of first lock plates.

16. The bladed rotor arrangement as claimed in claim 1, further comprising a turbine disc and a plurality of turbine rotor blades.

* * * * *